United States Patent [19]

Dunn et al.

[11] Patent Number: 4,906,888

[45] Date of Patent: Mar. 6, 1990

[54] ARRANGEMENT FOR SUPPORTING TWO DISCHARGE TUBES IN ONE ENVELOPE

[75] Inventors: John P. Dunn, Hammondsport; Kathleen P. Bernard, Painted Post, both of N.Y.

[73] Assignee: North American Philips Corporation, New York, N.Y.

[21] Appl. No.: 191,301

[22] Filed: May 6, 1988

[51] Int. Cl.[4] ..... H01J 61/04; H01J 61/34

[52] U.S. Cl. ..... 313/25; 313/1; 313/285

[58] Field of Search ..... 313/25, 1, 17, 284, 313/285, 288, 634

[56] References Cited

U.S. PATENT DOCUMENTS

| | | | |
|---|---|---|---|
| 2,103,029 | 12/1937 | Davies | 313/25 X |
| 4,287,454 | 9/1981 | Feuersanger et al. | 315/178 |
| 4,401,912 | 8/1983 | Martzloff et al. | 313/17 |

*Primary Examiner*—Kenneth A. Wieder

*Attorney, Agent, or Firm*—Robert T. Mayer

[57] ABSTRACT

A dual arc tube high pressure discharge lamp with a support frame connected to an electrical connector comprising a U-shaped piece of wire the axes of the legs of which are offset from the base so that the plane passing through the axes of the legs does not pass through the middle of the base of the wire.

7 Claims, 1 Drawing Sheet

ARRANGEMENT FOR SUPPORTING TWO DISCHARGE TUBES IN ONE ENVELOPE

This is an invention in the lamp art. More particularly, it concerns a dual arc tube discharge lamp which provides for rapid restart after temporary power outages.

This application is related to the concurrently filed application entitled "Sheet Metal Support for Dual Arc Discharge Lamps and Method of Making" applied for in the names of the same inventors as this application and assigned to the same assignee as this application. That application is hereby incorporated by reference herein.

High pressure discharge lamps with two discharge tubes mounted in one envelope are known, for example, from U.S. Pat. No. 4,689,518 entitled "High Pressure Discharge Lamp Mounting Structure" which is assigned to the assignee of this application. That patent teaches a new support structure for dual arc tube lamps. In contrast the invention disclosed herein teaches how to use components used in previous high pressure discharge lamps with only one discharge tube for use in dual arc tube lamps.

It is an object of the invention to use elements used successfully in previous arc tube discharge lamps in a new design.

One of the features of the invention is that a simplified element provides the desired spacing between the arc tubes of dual arc tube discharge lamps and locates them side by side and parallel to each other.

An advantage of the invention is that the same element which supports the dual arc tubes of a discharge lamp also provides electrical connection to each of the arc tubes and that this is accomplished by the simple task of welding that element to each of the arc tubes.

In accordance with the invention there is provided a high pressure discharge lamp including a light transmitting envelope with a longitudinal axis and two discharge tubes. Each of the discharge tubes has a first tubular electrode assembly at a first end. Also included is a coupling means adapted to couple the discharge tubes to a source of voltage located outside the envelope. The coupling means also mounts the discharge tubes side by side and parallel to each other equidistant from the longitudinal axis of the envelope. The coupling means includes stabilizing means inside each tubular electrode assembly. This structurally stabilizes the first end of each discharge tube while also providing an electrical connection to the first tubular assembly of each discharge tube.

In the presently preferred embodiment of the invention the stabilizing means is a U-shaped piece of wire welded to the electrode assemblies.

The U-shaped wire comprising the stabilizing means has the axes of its two legs offset from its base so that the plane passing through the axes of the legs does not pass through the middle of the base of the wire.

Other objects features and advantages of the invention will become apparent from the following description and appended claims when considered in conjunction with the accompanying drawing in which:

Figure 1:
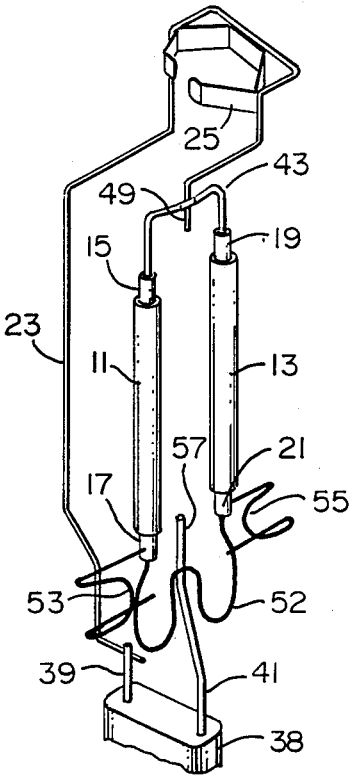
FIG. 1 is a perspective view of internal elements of the dual arc tube lamp of the invention.

It is to be understood that the drawing is not to scale and is for illustrative purposes.

Referring to FIG. 1 there is shown two arc discharge tubes 11 and 13. Each tube has an electrode assembly 15 and 17 and 19 and 21, respectively, at each of its ends. Arc tubes 11 and 13 are supported structurally by wire frame 23. Connected to the top of wire frame 23 is spring clip 25.

Figure 2:
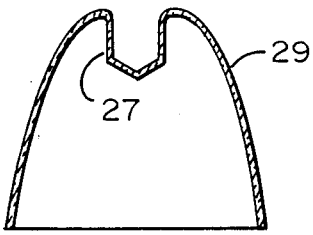
FIG. 2 is a cross-sectional view of the upper portion of the glass envelope which contains the elements of FIG. 1.
Figure 3:
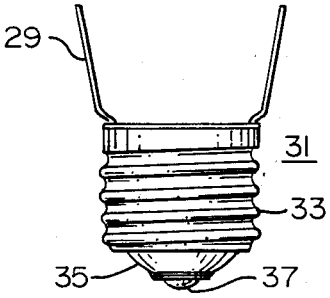
FIG. 3 is the bottom portion of the glass envelope of FIG. 2 together with the base of the lamp of the invention.

As those skilled in the art will understand in a finished lamp the elements of FIG. 1 are enclosed in glass envelope 29 (FIG. 2). For structural support spring clip 25 engages dimple 27 (FIG. 2) of glass envelope 29. A major portion of frame 23 is in a plane with the longitudinal axis of envelope 29. Envelope 29 is terminated at its bottom in a standard screw base 31 (FIG. 3) comprising screw shell 33, insulating glass 35 and eyelet 37.

Screw shell 33 and eyelet 37 provide electrical connection from a source of electrical power through lamp stem 38 to lead wires 39 and 41 (FIG. 1). Lead wire 39 is welded to wire frame 23. This provides electrical connection to electrode assemblies 15 and 19 of arc tubes 11 and 13 through wire frame 23 and stabilizing means 43. Stabilizing means 43 is a generally U-shaped piece of wire of 201 soft nickel with its legs 45 and 47 inserted into tubular electrode assemblies 15 and 19. In a finished lamp, legs 45 and 47 are welded to electrode assemblies 15 and 19. In order to prevent these upper electrode assemblies from being crushed during welding legs 45 and 47 are appropriately dimensioned with respect to the internal diameters of electrode assemblies 15 and 19. In one embodiment a 0.093 inch diameter wire was found to be appropriate for electrode assemblies with an internal diameter of 0.097 inch. As those skilled in the art will understand variations in internal electrode assembly diameters will result in variations in wire diameters.

Figure 4:
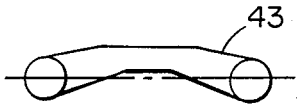
FIG. 4 is a bottom view of one of the elements of FIG. 1.
Figure 5:
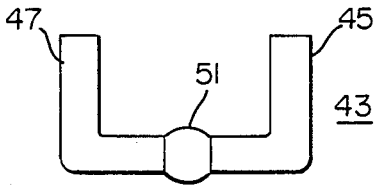
FIG. 5 is the plane view of the element of FIG. 4.

Leg 49 of wire frame 23 is centered in envelope 29. As a result legs 45 and 47 of stabilizing means 43 are offset from the base of element 43. That is to say, the axes of legs 45 and 47 are in a plane which does not pass through the middle of the base of wire 43 (see FIG. 4). This locates the axes of arc tubes 11 and 13 within envelope 29 in a plane with the central axis of the envelope, parallel to each other and equidistant from that central axis. In addition U-shaped member 43 has the middle of its base crimped so that depression 51 (FIG. 5) is formed in it. This facilitates welding U-shaped element 43 to leg 49 of wire frame 23 as is done in finished lamps. In use, lead wire 39, wire frame 23 and U-shaped member 43 comprise part of a coupling means for coupling the upper electrode assemblies of arc tubes 11 and 13 to a source of electrical power.

Figure 6:
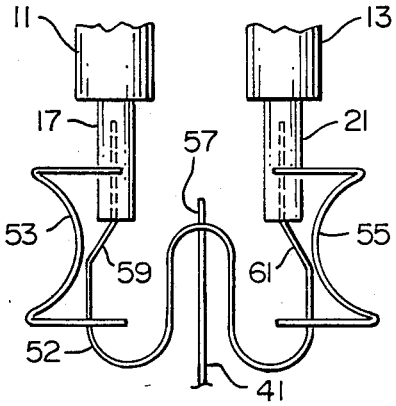
FIG. 6 is a plane view of other elements of FIG. 1.

Lead wire 41 (FIG. 1) provides electrical connection to the lower electrode assemblies 17 and 21 of arc tubes 11 and 13 through generally W-shaped element 52 and niobium connectors 53 and 55 (FIG. 6). Element 52 is welded for electrical connection and structural support to upper leg 57 of lead wire 41. Since upper leg 57 is also centered in envelope 29 it is to be understood that generally W-shaped element 52 has its outer legs 59 and 61 offset in the same manner as legs 45 and 47 of U-shaped element 43. Legs 59 and 61 are inserted into the lower electrode assemblies 17 and 21 of arc tubes 11 and 13 in a so-called "slip fit" manner. Depending upon the size of the wire used for W-shaped member 52 and the relative size of the internal diameters of assemblies 17 and 21 crimping of the ends of legs 59 and 61 in accordance with the method disclosed in U.S. Pat. No. 4,708,679 entitled "Method of Making Support Means for Discharge Lamp Tubes" and assigned to the assignee of this application, may be desirable.

Niobium strap connectors 53 and 55 are welded to legs 59 and 61 and to the outer walls of electrode assemblies 17 and 21 to complete the electrical connection to the arc tubes. Connectors 53 and 55, in one embodiment, are of the type disclosed in U.S. Pat. No. 4,712,040 entitled "Connector For High Pressure Lamps" assigned to the assignee of this application. Thermal expansion and contraction of the arc tubes is provided for by reason of the "slip fit" of legs 59 and 61. Lead wire 41, W-shaped member 52 and connectors 53 and 55 also comprise part of the coupling means of the invention.

It is to be understood that discharge tubes 11 and 13, frame 23, spring clip 25, envelope 29, lamp base 33, stem 38, leads 39 and 41 and connectors 53 and 55 are all elements previously used with single discharge tube high pressure lamps. All of these elements have been reused in the dual arc lamp herein disclosed.

It is also to be understood that although U-shaped element 43 and W-shaped element 52 are shown at the top and bottom of the discharge tubes, respectively, in some lamps these elements could be in reversed locations.

Various modifications of the above-described embodiment will be apparent to those skilled in the art. For that reason the arrangement described herein is for illustrative purposes and is not to be considered restrictive.

What is claimed is:

1. A high pressure discharge lamp including a light transmitting envelope with a longitudinal axis, two discharge tubes, each with a first tubular electrode assembly at a first end, coupling means adapted to couple said discharge tubes to a source of voltage located outside said envelope, said coupling means also mounting said discharge tubes side by side and parallel to each other equidistant from the longitudinal axis of said envelope, said coupling means including stabilizing means inside each first tubular electrode assembly structurally stabilizing the first end of each of said discharge tubes, said stabilizing means also providing an electrical connection to the first tubular electrode assembly of each of said discharge tubes, said stabilizing means being a U-shaped piece of wire welded to said electrode assemblies.

2. A high pressure discharge lamp as claimed in claim 1, wherein the axes of the two legs of the U-shaped wire are offset from the base so that the plane passing through said axes does not pass through the middle of the base of the U-shaped wire.

3. A high pressure discharge lamp as claimed in claim 2, wherein an associated one of said legs of said U-shaped wire is welded to each electrode assembly.

4. A high pressure discharge lamp as claimed in claim 3, wherein said coupling means includes a wire support frame for supporting said discharge tubes and wherein the middle of the base of said U-shaped wire has a depression formed in it to facilitate connecting it to said frame.

5. A high pressure discharge lamp as claimed in claim 4, wherein said U-shaped wire is welded to said frame.

6. A high pressure discharge lamp as claimed in claim 5, wherein each discharge tube has a second tubular electrode assembly and said coupling means includes a generally W-shaped wire with each of the outer legs of the generally W-shaped wire located in an associated second tubular electrode assembly, each outer leg having an electrically conductive strap welded to said outer leg and to its associated electrode assembly.

7. A high pressure discharge lamp as claimed in claim 6, wherein said coupling means includes a pair of lead wires passing through a seal from the inside to the outside of said envelope, one lead wire welded to said support frame and the other to said generally W-shaped wire.

* * * * *